United States Patent [19]

Johansson

[11] Patent Number: 4,605,585

[45] Date of Patent: Aug. 12, 1986

[54] FORMING FABRIC

[75] Inventor: Arne B. Johansson, Halmstad, Sweden

[73] Assignee: Nordiskafilt AB, Halmstad, Sweden

[21] Appl. No.: 481,901

[22] Filed: Apr. 4, 1983

[30] Foreign Application Priority Data

Apr. 26, 1982 [SE] Sweden ..... 8202578

[51] Int. Cl.[4] ..... B01D 39/08; D03D 15/00; D21F 7/08

[52] U.S. Cl. ..... 428/224; 139/383 A; 162/358; 162/DIG. 1

[58] Field of Search ..... 428/224; 162/358, DIG. 1; 139/383 A

[56] References Cited

U.S. PATENT DOCUMENTS

| | | | |
|---|---|---|---|
| 4,281,688 | 8/1981 | Kelly et al. | 139/383 A |
| 4,314,589 | 2/1982 | Buchanan et al. | 139/383 A |
| 4,333,502 | 6/1982 | Karm | 162/DIG. 1 |
| 4,344,464 | 8/1982 | Thompson et al. | 139/383 A |
| 4,356,225 | 10/1982 | Dufour | 428/234 |
| 4,361,618 | 11/1982 | Dufour et al. | 428/234 |
| 4,421,819 | 12/1983 | Baker | 139/383 A |
| 4,499,927 | 2/1985 | Borel | 139/383 A |
| 4,501,303 | 2/1985 | Osterberg | 139/383 A |

*Primary Examiner*—James C. Cannon

*Attorney, Agent, or Firm*—Kane, Dalsimer, Kane, & Kurucz

[57] ABSTRACT

A forming fabric consisting of synthetic yarns and intended for use in papermaking, cellulose and similar machines. The fabric comprises two layers, a top layer comprising fine yarns and forming the forming layer proper, and a bottom layer, the wear layer, comprising coarser yarns. The two layers are interconnected by interconnecting yarns which are arranged in pairs in such a manner that in the top layer they replace one another to form a regular pattern, preferably a two-shaft weave pattern, a twill weave pattern or a satin weave pattern.

5 Claims, 7 Drawing Figures

FORMING FABRIC

BACKGROUND OF THE INVENTION

The subject invention concerns a forming fabric for papermaking, cellulose and similar machines. The fabric comprises two layers of synthetic yarns, which layers are interconnected by synthetic yarns.

In the manufacture of paper on a papermaking machine, a slurry of fibres suspended in large quantities of water is allowed to flow onto a wire or cloth, which is permeable enough to permit drainage therethrough of the water in the slurry but prevents the fibres therein from passing through the cloth together with the water. Consequently, the fibres are retained and collected on the upper face of the cloth and are formed into a paper sheet. To avoid wire marking and fibre losses the paper-facing side of the fabric must be of a fine mesh weave. Originally single-layer fabrics, woven from metal threads were used. On account of their poor abrasion resistance metal wires have in later years been replaced by fabrics made from synthetic monofilament or multi-filament yarns. In their single-layer version these fabrics are unsatisfactory inasmuch as they are a great deal more tensile and flexible than the metal wires. For this reason, single-layer synthetic fabrics have met with little success for use on wide and high-speed paper-making machines.

In an attempt to combine the fine-mesh yarn systems required for forming and sheet-formation with the degree of stability required by machine runability, various multi-layer constructions of forming fabrics have been developed. In the beginning was used a multi-layer forming fabric of a geometrical construction which in practice made it impossible to move the knuckles of the warp and weft yarns on the forming side of the fabric to a common outer plane. The result was considerable marking of the paper web. According to the teachings of SE Published Specification 72 11347 the forming side was improved by arranging each warp yarn in such a manner that in addition to interconnecting the two weft layers it also interlaces separately with the layer of weft yarns which in position of use of the fabric faces the material to be formed, in addition to which this layer of weft yarns as well as the warp yarns interconnecting these weft layers are essentially tangent to the (outer) plane of the fabric facing said material.

This improved forming face was retained in the construction disclosed in the Swedish Published Specification 74 12722-6. The characteristic features of the latter Patent Specification is that in the layer of weft yarns which in the position of use of the fabric faces the dewatering elements of the machine each warp yarns binds with every sixth weft yarn or less frequently.

The paper-facing side of the fabric must be of a fine mesh weave whereas the opposite side, which is exposed to considerable wear and abrasion, must be wear resistant and stable. Obviously, the requirements on the two sides of the fabric thus are in conflict with one another. One solution to these conflicting problems is found in the construction disclosed in Swedish Patent Specification 78 06764-2. The construction according to this publication consists of two complete weaves, each one comprising its separate, interconnected sets of warp yarns and weft yarns. The weave portion closest to the material to be formed as a rule consists of fine yarns which are woven into a fine-mesh weave construction whereas the bottom portion consists of coarser and more wear-resistant yarns which are woven into a more coarse mesh weave. The two weaves are interconnected either with the aid of separate binder yarns or by means of pairs of yarns which recur in sequence and which from the top cloth alternately interlace with the bottom cloth. The best fabric structure so far has proved to be one comprising a forming side weave of a two-shaft construction and a bottom side weave of either a two-shaft or a four-shaft construction, these weave constructions being interconnected by separate binder weft yarns. However, this construction is unsatisfactory because the binder weft yarns cause friction on the yarns of the two weaves, resulting in wear and rupture of the binder weft yarns.

SUMMARY OF THE INVENTION

The purpose of the subject invention is to eliminate these problems while at the same time retaining the regularity of the pattern on the forming side of the weave. This is achieved in that two consecutive yarns which are arranged to interconnect the two layers, together form a regular pattern, preferably in a two-shaft, twill or satin weave, when weaving with the layer of yarns (top layer) which in position of use of the fabric faces the material to be formed.

Further characteristics of the invention will appear from the appended claims.

The advantage of the weave binding pattern of the subject invention resides in the elimination of the separate binder yarn. The yarns which interconnect the top and bottom layers from a regular pattern on the forming side of the fabric.

BRIEF DESCRIPTION OF THE DRAWINGS

The invention will be described in closer detail in the following with reference to the accompanying drawings, wherein.

DETAILED DESCRIPTION OF PREFERRED EMBODIMENTS

Figure 1:
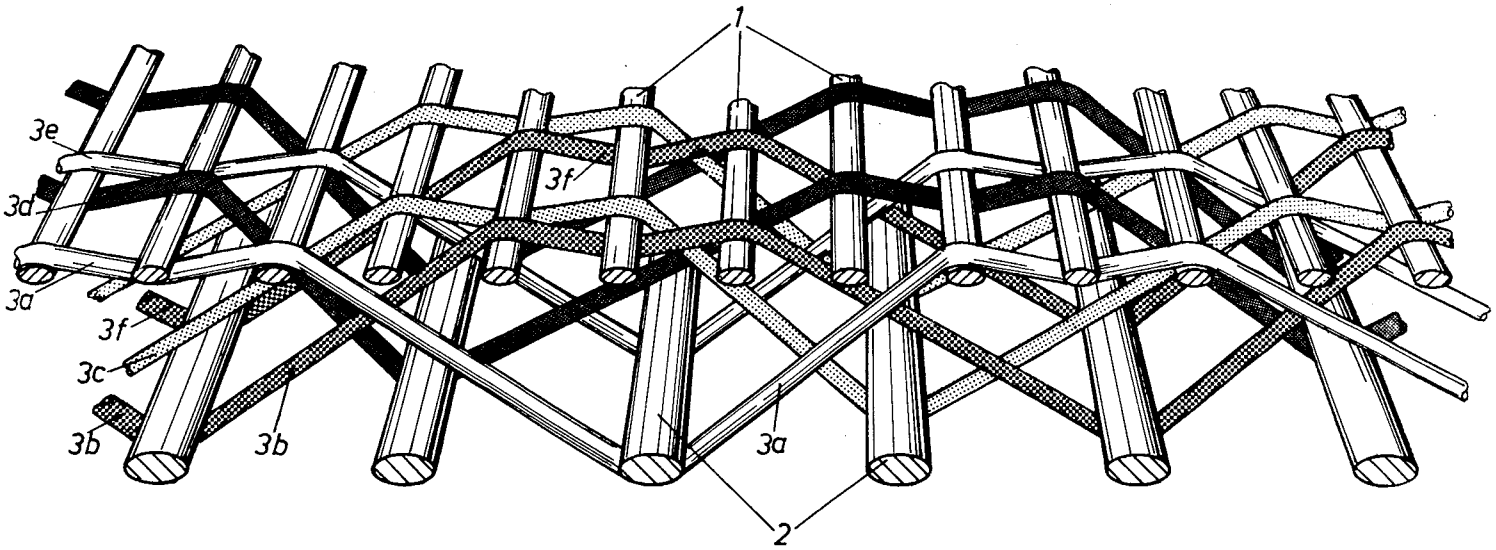
FIG. 1 is a perspective view of the fabric in accordance with one embodiment thereof.

FIG. 1 shows a part of a fabric in accordance with the invention, the yarns making up the fabric having been pulled apart in order to show the weave pattern clearly. The fabric comprises a top layer comprising fine yarns 1, a bottom layer comprising preferably coarser yarns 2, and yarns interconnecting the two layers. These interconnecting yarns 3 are arranged in pairs, respectively 3*a* and 3*b*, 3*c* and 3*d*, 3*e* and 3*f*, in such a manner that when the first yarn 3*a*, 3*c*, and so on, of each pair of yarns is carried downwards through the weave to interweave with the bottom yarn layer 2, thus interconnecting this layer with the upper yarn layer 1, the second yarn 3*b*, 3*d*, and so on of the same pair, is carried upwards through the weave. These two yarns 3*a* and 3*b* of each pair change places throughout the entire weave in such a manner that together they weave reagularly with the yarns 1 of the upper layer, in FIG. 1 in a two-shaft weave pattern.

Figure 2:
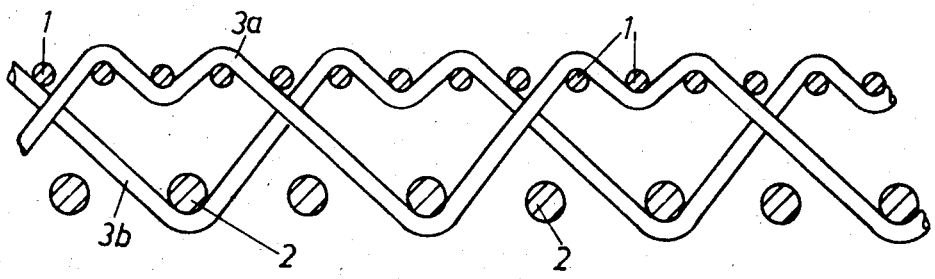
FIGS. 2–7 are lateral views of various fabric constructions in accordance with the teachings of the subject invention.

FIG. 2 shows the same weave construction as FIG. 1 but in a lateral view. The interconnecting yarns 3*a* and 3*b* *together form a yarn pair. When yarn 3a* is carried downwards through the fabric to interlace with the yarns 2 in the bottom layer the second yarn 3*b* of the pair is carried upwards towards the top layer and continues to weave in a regular pattern with the yarns 1. The interconnecting yarns 3*a* and 3*b* weave in a two-shaft pattern with the yarns 1 of the top layer, as appears in FIG. 1.

Figure 3:
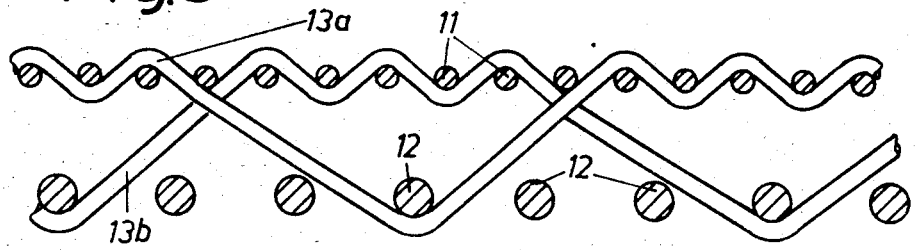
Figure 4:
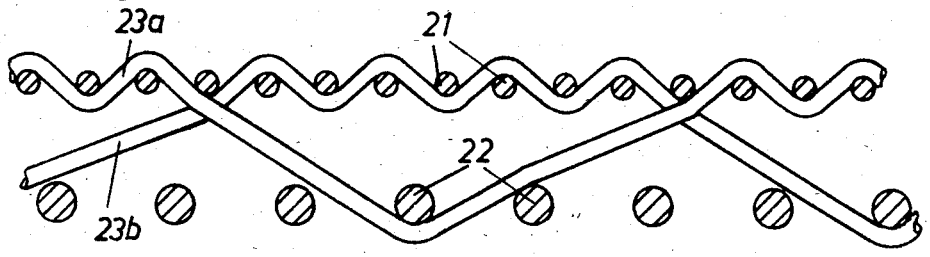

FIGS. 3 and 4 show two alternative embodiments. Also in accordance with these embodiments the interconnecting yarn pairs 13*a*, 13*b* and 23*a*, 23*b*, respectively, bind in a two-shaft weave pattern with the yarns 11 and 21, respectively of the top layer. The distance over which the layer-interconnecting yarns interlace with the top layer yarns is somewhat longer than in the case of the weave construction in accordance with FIG. 2. The coarser yarns of the bottom layer are designated respectively 12 and 22.

Figure 5:
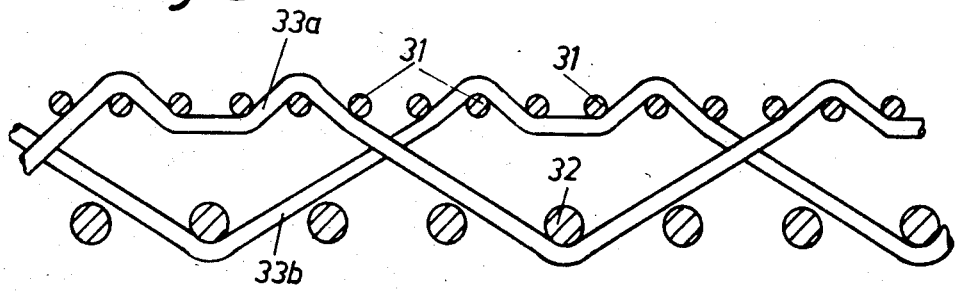

In accordance with FIG. 5 yarn pair 33*a* and 33*b* interlace with yarns 31 of the upper layer in a three-shaft weave pattern and are carried down to interlace with the yarns 32 of the bottom layer.

Figure 6:
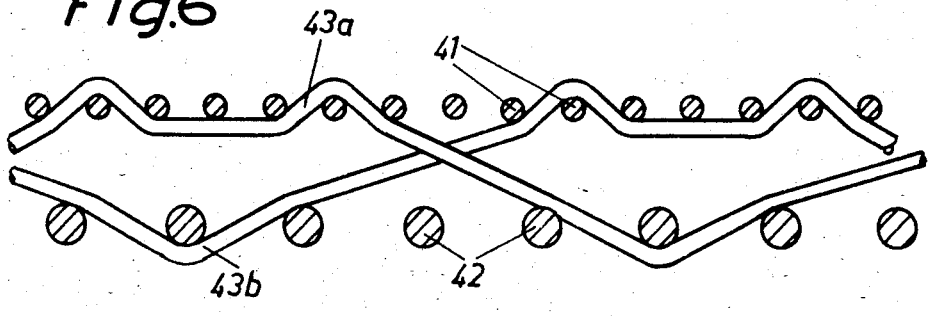

In accordance with FIG. 6 yarn pair 43*a* and 43*b* interlace with yarns 41 of the top layer in a four-shaft weave pattern. The yarns of the bottom layer are designated by reference 42.

Figure 7:
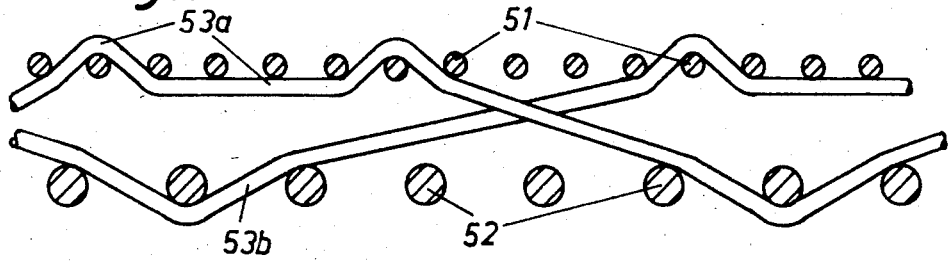

Finally, in accordance with FIG. 7 yarn pair 53*a* and 53*b* interlace with yarns 51 of the top layer in a five-shaft weave pattern. The yarns of the bottom layer are designated by reference 52.

The invention is not limited to the embodiments described in the aforegoing and illustrated in the drawings but a variety of modifications are possible within the scope of the appended claims. All embodiments illustrated comprise a top layer in which the number of weft yarns is double that of the weft yarns of the bottom layer but other relationships are possible. Usually, the interconnecting yarns 3, 13, and so on, are warp yarns and the yarns of the top and bottom layers are weft yarns but the opposite should also be possible.

What I claim is:

1. An improved open mesh fabric for papermaking cellulose and similar machines, said fabric comprising:

a first system of synthetic yarns, said first system forming a layer which in position of use of said fabric faces the material to be formed;

a second system of synthetic yarns, said second system forming a layer which in position of use of said fabric faces the dewatering elements of said machine;

a third system of synthetic yarns in cross direction to said first and second systems, said third system interwoven with and interconnecting said first and second systems; and said third system consists of pairs of first and second yarns, said first and second yarns of each said pair together and alternately forming a pattern in the same phase in the face of said fabric which in position of use is to face the material to be formed and with first and second yarns of other pairs of adjoining yarns form a regular pattern when woven with said first system.

2. An improved forming fabric as claimed in claim 1, comprising the yarns of said first and said second systems being weft yarns and the interconnecting yarns being warp yarns.

3. An improved forming fabric as claimed in claim 1, wherein said pairs of interconnecting yarns weave in a two-shaft weave pattern in said layer which in position of use faces the material to be formed.

4. An improved forming fabric as claimed in claim 1, wheren said pairs of interconnecting yarns weave in a twill weave pattern in said layer which in position of use faces the material to be formed.

5. An improved forming fabric as claimed in claim 1, wherein said pairs of interconnecting yarns weave in a satin weave pattern in said layer which in position of use faces the material to be formed.

* * * * *